US009491542B2

(12) United States Patent
Usher

(10) Patent No.: US 9,491,542 B2
(45) Date of Patent: Nov. 8, 2016

(54) AUTOMATIC SOUND PASS-THROUGH METHOD AND SYSTEM FOR EARPHONES

(71) Applicant: Personics Holdings, LLC, Boca Raton, FL (US)

(72) Inventor: John Usher, Devon (GB)

(73) Assignee: Personics Holdings, LLC, Boca Raton, FL (US)

( * ) Notice: Subject to any disclaimer, the term of this patent is extended or adjusted under 35 U.S.C. 154(b) by 0 days.

(21) Appl. No.: 14/600,349

(22) PCT Filed: Jul. 30, 2013

(86) PCT No.: PCT/US2013/052673

§ 371 (c)(1),
(2) Date: Jan. 20, 2015

(87) PCT Pub. No.: WO2014/022359

PCT Pub. Date: Feb. 6, 2014

(65) Prior Publication Data

US 2015/0215701 A1 Jul. 30, 2015

Related U.S. Application Data

(60) Provisional application No. 61/677,049, filed on Jul. 30, 2012.

(51) Int. Cl.
*H04R 3/00* (2006.01)
*H04R 1/10* (2006.01)

(52) U.S. Cl.
CPC ..... *H04R 3/002* (2013.01); *H04R 1/1041* (2013.01); *H04R 1/1016* (2013.01); *H04R 3/005* (2013.01); *H04R 2420/01* (2013.01); *H04R 2420/07* (2013.01); *H04R 2430/01* (2013.01)

(58) Field of Classification Search
CPC ..... H04R 3/002
See application file for complete search history.

(56) References Cited

U.S. PATENT DOCUMENTS

| | | | |
|---|---|---|---|
| 6,415,034 | B1 | 7/2002 | Hietanen |
| 7,532,717 | B2 | 5/2009 | Nishimura |
| 2006/0133621 | A1 | 6/2006 | Chen et al. |
| 2006/0262938 | A1 | 11/2006 | Gauger, Jr. et al. |
| 2008/0260180 | A1 | 10/2008 | Goldstein et al. |
| 2009/0010442 | A1 | 1/2009 | Usher et al. |
| 2009/0016542 | A1 | 1/2009 | Goldstein et al. |
| 2009/0220096 | A1 | 9/2009 | Usher et al. |

FOREIGN PATENT DOCUMENTS

| | | |
|---|---|---|
| WO | WO2014/022359 | 2/2014 |

OTHER PUBLICATIONS

International Searching Authority for International Application No. PCT/US2013/052673, International Preliminary Report on Patentability issued Feb. 3, 2015 and Written Opinion dated Jan. 16, 2014.

*Primary Examiner* — Paul Huber
(74) *Attorney, Agent, or Firm* — Pablo Meles

(57) ABSTRACT

Earphone systems and methods for automatically directing ambient sound to an earphone device are provided. An ambient microphone signal from an ambient microphone proximate a sound isolating earphone or headset device is directed to a receiver within an earphone device according to mixing circuitry. The mixing circuitry is controlled by voice activity of the earphone device wearer. This enables hands-free operation of an earphone system to allow the earphone device wearer to maintain situation awareness with the surrounding environment. During detected voice activity, incoming audio content is attenuated while ambient sound is increased and provided to the earphone device. User voice activity is detected by analysis of at least one of an ear canal microphone signal or an ambient sound microphone signal.

21 Claims, 7 Drawing Sheets

AUTOMATIC SOUND PASS-THROUGH METHOD AND SYSTEM FOR EARPHONES

CROSS REFERENCE TO RELATED APPLICATIONS

This application is related to and claims the benefit of U.S. Provisional Application No. 61/677,049 entitled "AUTOMATIC SOUND PASS-THROUGH METHOD AND SYSTEM FOR EARPHONES" filed on Jul. 30, 2012, the contents of which are incorporated herein by reference.

FIELD OF INVENTION

The present invention relates to earphones and headphones and, more particularly, to earphone systems, headphone systems and methods for automatically directing ambient sound to a sound isolating earphone device or headset device used for voice communication and music listening, to maintain situation awareness with hands-free operation.

BACKGROUND OF THE INVENTION

Sound isolating (SI) earphones and headsets are becoming increasingly popular for music listening and voice communication. Existing SI earphones enable the user to hear an incoming audio content signal (such as speech or music audio) clearly in loud ambient noise environments, by attenuating the level of ambient sound in the user's ear canal.

A disadvantage of SI earphones/headsets is that the user may be acoustically detached from their local sound environment. Thus, communication with people in the user's immediate environment may therefore impaired.

SUMMARY OF THE INVENTION

The present invention relates to a method for passing ambient sound to an earphone device configured to be inserted in an ear canal of a user. Ambient sound is captured from an ambient sound microphone (ASM) proximate to the earphone device to form an ASM signal. An audio content (AC) signal is received from a remote device. Voice activity of the user of the earphone device is detected. The ASM signal and the AC signal are mixed to form a mixed signal, such that, in the mixed signal, an ASM gain of the ASM signal is increased and an AC gain of the AC signal is decreased when the voice activity is detected. The mixed signal is directed to an ear canal receiver (ECR) of the earphone device.

The present invention also relates to an earphone system. The earphone system includes at least one earphone device and a signal processing system. The at least one earphone device includes a sealing section configured to conform to an ear canal of a user of the earphone device, an ear canal receiver (ECR) and an ambient sound microphone (ASM) for capturing ambient sound proximate to the earphone device and to form an ASM signal. The signal processing system is configured to: receive an audio content (AC) signal from a remote device; detect voice activity of the user of the earphone device; mix the ASM signal and the AC signal to form a mixed signal, such that, in the mixed signal, an ASM gain of the ASM signal is increased and an AC gain of the AC signal is decreased when the voice activity is detected; and direct the mixed signal to the ECR.

BRIEF DESCRIPTION OF THE DRAWINGS

The invention may be understood from the following detailed description when read in connection with the accompanying drawing. It is emphasized, according to common practice, that various features of the drawings may not be drawn to scale. On the contrary, the dimensions of the various features may be arbitrarily expanded or reduced for clarity. Moreover, in the drawing, common numerical references are used to represent like features. Included in the drawing are the following figures.

DETAILED DESCRIPTION OF THE INVENTION

Figure 1:
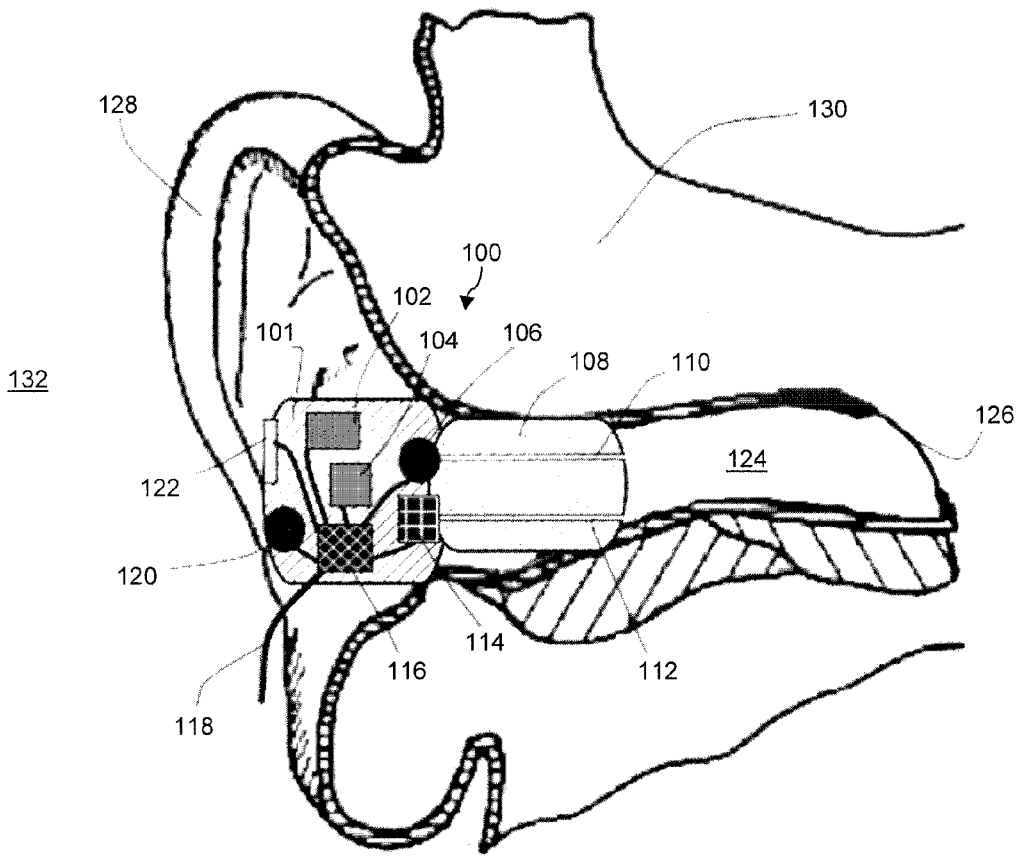
FIG. 1 is a cross-sectional view diagram of an exemplary earphone device inserted in an ear, illustrating various components which may be included in the earphone device, according to an embodiment of the present invention.

The following description of exemplary embodiment(s) is merely illustrative in nature and is in no way intended to limit the invention, its application, or uses. Exemplary embodiments are directed to or can be operatively used on various wired or wireless earphone devices (also referred to herein as earpiece devices) (e.g., earbuds, headphones, ear terminals, behind the ear devices or other acoustic devices as known by one of ordinary skill, and equivalents).

Processes, techniques, apparatus, and materials as known by one of ordinary skill in the art may not be discussed in detail but are intended to be part of the enabling description where appropriate.

Additionally exemplary embodiments are not limited to earpiece devices, for example some functionality can be implemented on other systems with speakers and/or microphones for example computer systems, PDAs, BlackBerry® smartphones, mobile phones, and any other device that emits or measures acoustic energy. Additionally, exemplary embodiments can be used with digital and non-digital acoustic systems. Additionally, various receivers and microphones can be used, for example micro-electro-mechanical systems (MEMs) transducers or diaphragm transducers.

To enable an SI earphone user to hear their local ambient environment, conventional SI earphones often incorporate ambient sound microphones to pass through local ambient sound to a loudspeaker in the SI earphone. In existing systems, the earphone user must manually activate a switch to enable the ambient sound pass-through. Such a manual activation may be problematic. For example, if the user is wearing gloves or has their hands engaged holding another device (e.g., a radio or a weapon), it may be difficult to press an "ambient sound pass-through" button or switch. The user may miss important information in their local ambient sound field due to the delay in reaching for the ambient sound pass-through button or switch. Also, the user may have to press the button or switch a second time to revert back to a "non ambient sound pass-through" mode. A need exists for a "hands-free" mode of operation to provide ambient sound pass-through for an SI earphone.

Embodiments of the invention relates to earphone devices and earphone systems (or headset systems) including at least one earphone device. An example earphone system (or headset system) of the subject invention may be connected to a remote device such as a voice communication device (e.g., a mobile phone, a radio device, a computer device) and/or an audio content delivery device (e.g., a portable media player, a computer device), as well as a further earphone device (which may be associated with the user or another use). The earphone device may include a sound isolating component for blocking a meatus of a user's ear (e.g., using an expandable element such as foam or an expandable balloon); an ear canal receiver (ECR) (i.e., a loudspeaker) for receiving an audio signal and generating a sound field in an ear canal of the user; and at least one ambient sound microphone (ASM) for capturing ambient sound proximate to the earphone device and for generating at least one ASM signal. A signal processing system may receive an audio content (AC) signal from the remote device (such as the voice communication device or the audio content delivery device); and may further receive the at least one ASM signal. The signal processing system mixes the at least one ASM signal and the AC signal and may transmit the resulting mixed signal to the ECR in the earphone device. The mixing of the at least one ASM signal and the AC signal may be controlled by voice activity of the user.

The earphone device may also include an Ear Canal Microphone (ECM) for capturing sound in the user's occluded ear-canal and for generating an ECM signal. An example earphone device according to the subject invention detects the voice activity of the user by analysis of the ECM signal from the ECM (where the ECM detects sound in the occluded ear canal of the user), analysis of the at least one ASM signal or the combination thereof.

According to an exemplary embodiment, when voice activity is detected, a level of the ASM signal provided to the ECR is increased and a level of the AC signal provided to the ECR is decreased. When voice activity is not detected, a level of the ASM signal provided to the ECR is decreased and a level of the AC signal provided to the ECR is increased.

In an example earphone device, following cessation of the detected user voice activity, and following a "pre-fade delay," the level of the ASM signal provided to the ECR is decreased and the level of the AC signal fed to the ECR is increased. In an exemplary embodiment, a time period of the "pre-fade delay" may be proportional to a time period of continuous user voice activity before cessation of the user voice activity. The "pre-fade delay" time period may be bound by an upper predetermined limit.

Aspects of the present invention may include methods for detecting user voice activity of an earphone system (or headset system). In an exemplary embodiment, a microphone signal level value (e.g., from the ASM signal and/or the ECM signal) may be compared with a microphone threshold value. An AC signal level value (from the input AC signal (e.g. speech or music audio from a remote device such as a portable communications device or media player)) may be compared with an AC threshold value. In an exemplary embodiment, the AC threshold value may be generated by multiplying a linear AC threshold value with a current linear AC signal gain. It may be determined whether the microphone Level value is greater than the microphone threshold value. According to another example, it may be determined whether the microphone level value is greater than the microphone threshold value and whether the AC level value is less than the AC threshold value. If the conditions are met, then a voice activity detector (VAD) may be set to an on state. Otherwise the VAD may be set to an off state.

In an example method, the microphone signal may be band-pass filtered, and a time-smoothed level of the filtered microphone signal may be generated (e.g., smoothed using a 100 ms Hanning window) to form the microphone signal level value. In addition, the AC signal may be band-pass filtered, and a time-smoothed level of the filtered AC signal may be generated (e.g., smoothed using a Hanning window) to form the AC signal level value.

Referring to FIG. 1, a cross-sectional view diagram of an exemplary earphone device 100 is shown. Earphone device 100 is shown relative to ear 130 of a user. FIG. 1 also illustrates a general physiology of ear 130. An external portion of ear 130 includes pinna 128. An internal portion of ear 130 includes ear canal 124 and eardrum 126 (i.e., a tympanic membrane).

Pinna 128 is a cartilaginous region of ear 130 that focuses acoustic information from ambient environment 132 to ear canal 124. In general, sound enters ear canal 124 and is subsequently received by eardrum 126. Acoustic information resident in ear canal 124 vibrates eardrum 126. The vibration is converted to a signal (corresponding to the acoustic information) that is provided to an auditory nerve (not shown).

Earphone device 100 may include sealing section 108. Earphone device 100 may be configured to be inserted into ear canal 124, such that sealing section 108 forms a sealed volume between sealing section 108 and eardrum 126. Thus, ear canal 124 represents an occluded ear canal (i.e., occluded by sealing section 108). Sealing section 108 may be configured to seal ear canal 124 from sound (i.e., provide sound isolation from ambient environment 132 external to ear canal 124). In general, sealing section 108 may be configured to conform to ear canal 124 and to substantially isolate ear canal 124 from ambient environment 132.

Sealing section 108 may be operatively coupled to housing unit 101. As shown in FIG. 1, housing unit 101 of earphone device 100 may include one or more components which may be included in earphone device 100. Housing unit 101 may include battery 102, memory 104, ear canal microphone (ECM) 106, ear canal receiver 114 (ECR) (i.e., a loudspeaker), processor 116, ambient sound microphone (ASM) 120 and user interface 122. Although one ASM 120 is shown, earphone device 100 may include one or more ambient sound microphones 120. In an exemplary embodiment, ASM 120 may be located at the entrance to the ear meatus. ECM 106 and ECR 114 are acoustically coupled to (occluded) ear canal 124 via respective ECM acoustic tube 110 and ECR acoustic tube 112.

In FIG. 1, housing unit 101 is illustrated as being disposed in ear 130. It is understood that various components of earphone device 100 may also be configured to be placed behind ear 130 or may be placed partially behind ear 130 and partially in ear 130. Although a single earphone device 100 is shown in FIG. 1, an earphone device 100 may be included for both the left and right ears of the user, as part of a headphone system.

Memory 104 may include, for example, a random access memory (RAM), a read only memory (ROM), static RAM (SRAM), dynamic RAM (DRAM), flash memory, a magnetic disk, an optical disk or a hard drive.

Although not shown, housing unit 101 may also include a pumping mechanism for controlling inflation/deflation of sealing section 108. For example, the pumping mechanism may provide a medium (such as a liquid, gas or gel capable of expanding and contracting sealing section 108) and that would maintain a comfortable level of pressure for a user of earphone device 100.

User interface 122 may include any suitable buttons and/or indicators (such as visible indicators) for controlling operation of earphone device 100. User interface 122 may be configured to control one or more of memory 104, ECM 106, ECR 114, processor 116 and ASM 120. User interface 122 may also control operation of a pumping mechanism for controlling sealing section 108.

In general, ECM 106, ASM 120 may each be any suitable transducer capable of converting a signal from the user into an audio signal. Although examples below describe diaphragm microphones, the transducers may include electromechanical, optical or piezoelectric transducers. The transducer may also include bone conduction microphone. In an example embodiment, the transducer may be capable of detecting vibrations from the user and converting the vibrations to an audio signal. Similarly, ECR 114 may be any suitable transducer capable of converting an electric signal (i.e., an audio signal) to an acoustic signal.

All transducers (such as ECM 106, ECR 114 and ASM 120) may respectively receive or transmit audio signals to processor 116 in housing unit 101. Processor 116 may undertake at least a portion of the audio signal processing described herein. Processor 116 may include, for example, a logic circuit, a digital signal processor or a microprocessor.

Earphone device 100 may be configured to communicate with a remote device (described further below with respect to FIG. 2) via communication path 118. In general, the remote device may include another earphone device, a computer device, an audio content delivery device, a communication device (such as a mobile phone), an external storage device, a processing device, etc. For example, earphone device 100 may include a communication system (such as data communication system 216 shown in FIG. 2) coupled to processor 116. In general, earphone device 100 may be configured to receive and/or transmit signals. Communication path 118 may include a wired or wireless connection.

Sealing section 108 may include, without being limited to, foam, rubber or any suitable sealing material capable of conforming to ear canal 124 and for sealing ear canal 124 to provide sound isolation.

According to an exemplary embodiment, sealing section 108 may include a balloon capable of being expanded. Sealing section 108 may include balloons of various shapes, sizes and materials, for example constant volume balloons (low elasticity<=50% elongation under pressure or stress) and variable volume (high elastic>50% elongation under pressure or stress) balloons. As described above, a pumping mechanism may be used to provide a medium to the balloon. The expandable balloon may seal ear canal 124 to provide sound isolation.

If sealing section 108 includes an expandable balloon, sealing section 108 may be formed from any compliant material that has a low permeability to a medium within the balloon. Examples of materials of an expandable balloon include any suitable elastomeric material, such as, without being limited to, silicone, rubber (including synthetic rubber) and polyurethane elastomers (such as Pellethane® and Santoprene™). Materials of sealing section 108 may be used in combination with a barrier layer (for example, a barrier film such as SARANEX™), to reduce the permeability of sealing section 108. In general, sealing section 108 may be formed from any suitable material having a range of Shore A hardness between about 5 A and about 30 A, with an elongation of about 500% or greater.

Figure 2:
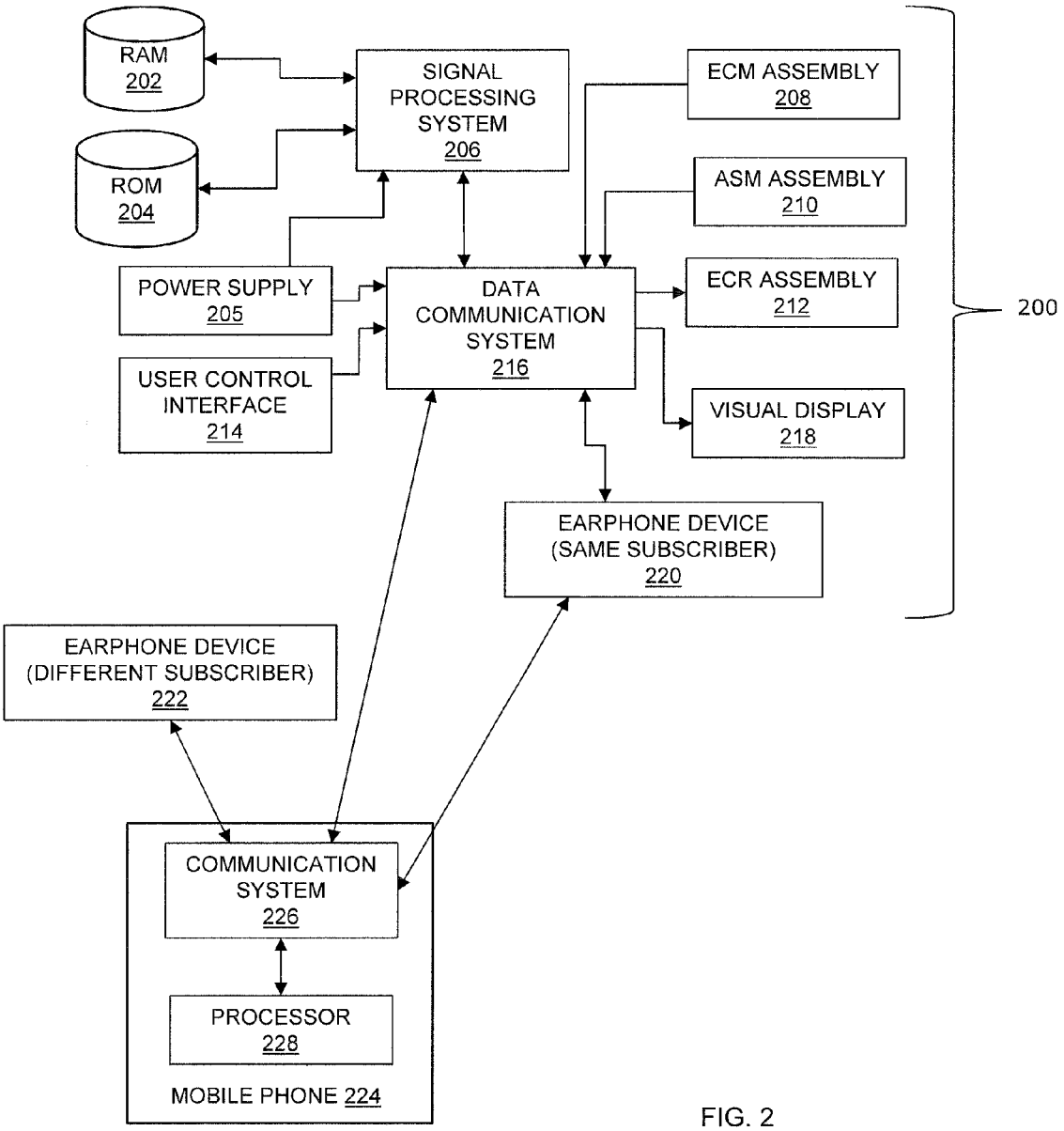
FIG. 2 is functional block diagram of an exemplary earphone system in relation to other data communication systems, according to an embodiment of the present invention.

FIG. 2 is a functional block diagram of exemplary earphone system 200 (also referred to herein as system 200), according to an exemplary embodiment of the present invention. System 200 may be configured to communicate with other electronic devices and network systems, such as earphone device 220 (e.g., another earphone device of the same subscriber), earphone device 222 (e.g., an earphone device of a different subscriber), and/or mobile phone 228 of the user (which may include communication system 224 and processor 226).

FIG. 2 illustrates exemplary hardware of system 200 to support signal processing and communication. System 200 may include one or more components such as RAM 202, ROM 204, power supply 205, signal processing system 206 (which may include a logic circuit, a microprocessor or a digital signal processor), ECM assembly 208, ASM assembly 210, ECR assembly 212, user control interface 214, data communication system 216, and visual display 218.

RAM 202 and/or ROM 204 may be part of memory 104 (FIG. 1) of earphone device 100. Power supply 205 may include battery 102 of earphone device 100. ECM assembly 208, ASM assembly 210 and ECR assembly 212 may include respective ECM 106 (FIG. 1), ASM 120 and ECR 114 of earphone device 100 (as well as additional electronic components). User control interface 214 and/or visual display 218 may be part of user interface 122 (FIG. 1) of earphone device 100. Signal processing system 206 (described further below) may be part of processor 116 (FIG. 1) of earphone device 100

Data communication system 216 may be configured, for example, to communicate (wired or wirelessly) with communication circuit 224 of mobile phone 228 as well as with earphone device 220 or earphone device 222. In FIG. 2, communication paths between data communication system 216, earphone device 220, earphone device 222 and mobile phone 224 may represent wired and/or wireless communication paths.

In an example embodiment, earphone system 200 may include one earphone device 100 (FIG. 1). In another example, system 200 may include two earphone devices 100 (such as in a headphone system). Accordingly, in a headphone system, system 200 may also include earphone device 220. In a headphone system, each earpiece device 100 may include one or more components such as RAM 202, ROM 204, power supply 205, signal processing system 206, and data communication system 216. In another example, one or more components of these components (e.g., RAM 202, ROM 204, power supply 205, signal processing system 206 or data communication system 216) may be shared by both earpiece devices.

Figure 3:
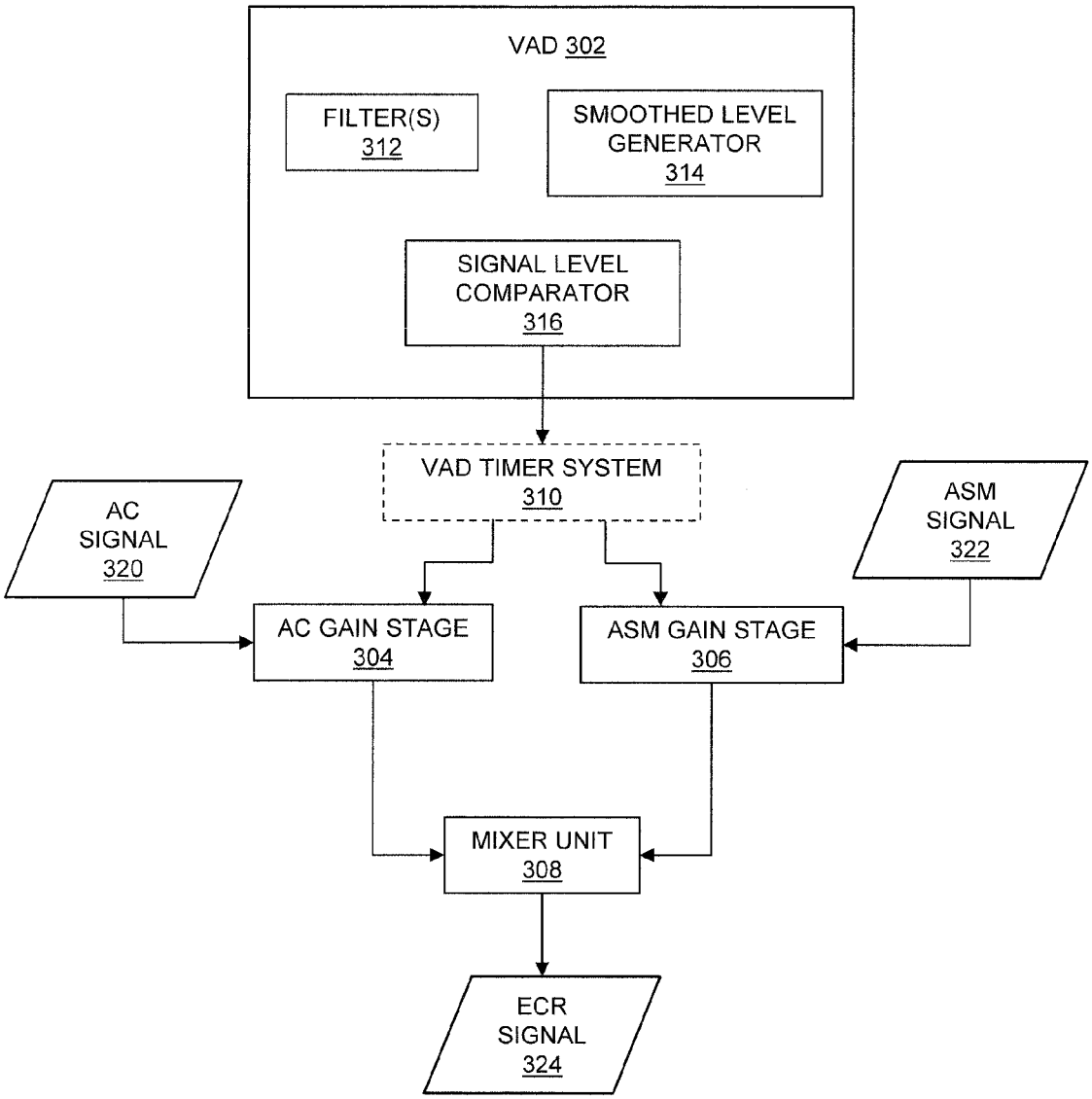
FIG. 3 is a functional block diagram of an exemplary signal processing system for automatic sound pass-through of ambient sound to an ear canal receiver (ECR) of a sound isolating earphone device, according to an embodiment of the present invention.

Referring next to FIG. 3, a functional block diagram of an exemplary signal processing system 206 is shown. Signal processing system 206 may be part of processor 116 (FIG. 1) of earphone device 100 and may be configured to provide automatic sound pass-through of ambient sound to ECR 114 of earphone device 100. Signal processing system 206 may include voice activity detection (VAD) system 302, AC gain stage 304, ASM gain stage 306. mixer unit 308 and optional VAD timer system 310.

Signal processing system 206 receives an audio content (AC) signal 320 from a remote device (such as a communication device (e.g. mobile phone, earphone device 220, earphone device 222, etc.) or an audio content delivery device (e.g. music player)). Signal processing system 206 further receives ASM signal 322 from ASM 120 (FIG. 1).

A linear gain may be applied to AC signal 320 by AC gain stage 304, using gain coefficient Gain_AC, to generate a modified AC signal. In some embodiments, the gain (by gain stage 304) may be frequency dependent. A linear gain may also be applied to ASM signal 322 in gain stage 306, using gain coefficient Gain_ASM, to generate a modified ASM signal. In some embodiments, the gain (in gain stage 306) may be frequency dependent.

Gain coefficients Gain_AC and Gain_ASM may be generated according to VAD system 302. Exemplary embodiments of VAD system 302 are provided in FIGS. 4, 5, 6A and 6B and are described further below. In general, VAD 302 may include one or more filters 312, smoothed level generator 314 and signal level comparator 316.

Filter 312 may include predetermined fixed band-pass and/or high-pass filters (described further below with respect to FIGS. 4, 6A and 6B). Filter 312 may also include an adaptive filter (described further below with respect to FIG. 5). Filter 312 may be applied to ASM signal 322, AC signal 320 and/or an ECM signal generated by ECM 106 (FIG. 1). Gain stages 304, 306 may include analog and/or digital components.

Smoothed level generator 314 may receive at least one of a microphone signal (e.g., ASM signal 322 and/or an ECM signal) and AC signal 320 and may determine respective time-smoothed level value of the signal. In an example, generator 314 may use a 100 ms Hanning window to form a time-smoothed level value.

Signal level comparator 316 may use at least the microphone level (value) to detect voice activity. In another example, comparator 316 may use the microphone level and the AC level to detect voice activity. If voice activity is detected, comparator 316 may set a VAD state to an on state. If voice activity is not detected, comparator 316 may set a VAD state to an off state.

In general, VAD system 302 determines when the user of earphone device 100 (FIG. 1) is speaking. VAD system 302 sets Gain_AC (gain stage 304) to a high value and Gain_ASM (gain stage 306) to a low value when no user voice activity is detected. VAD system 302 sets Gain_AC (gain stage 304) to a low value and Gain_ASM (gain stage 306) to a high value when user voice activity is detected. The gain coefficients of gain stages 304, 306 for the on and off states may be stored, for example, in memory 104 (FIG. 1).

The modified AC signal and the modified ASM signal from respective gain stages 306 and 310 may be summed together with mixer unit 308. The resulting mixed signal may be directed towards ECR 114 (FIG. 1) as ECR signal 324.

Signal processing system 206 may include optional VAD timer system 310. VAD timer system 310 may provide a time period of delay (i.e., a pre-fade delay), between cessation of detected voice activity and switching of gains by gain states 304, 306 associated with the VAD off state. In an exemplary embodiment, the time period may be proportional to a time period of continuous user voice activity (before the voice activity is ceased). The time period may be bound by a predetermined upper limit (such as 10 seconds). VAD timer system 310 is described further below with respect to FIG. 7.

Figure 4:
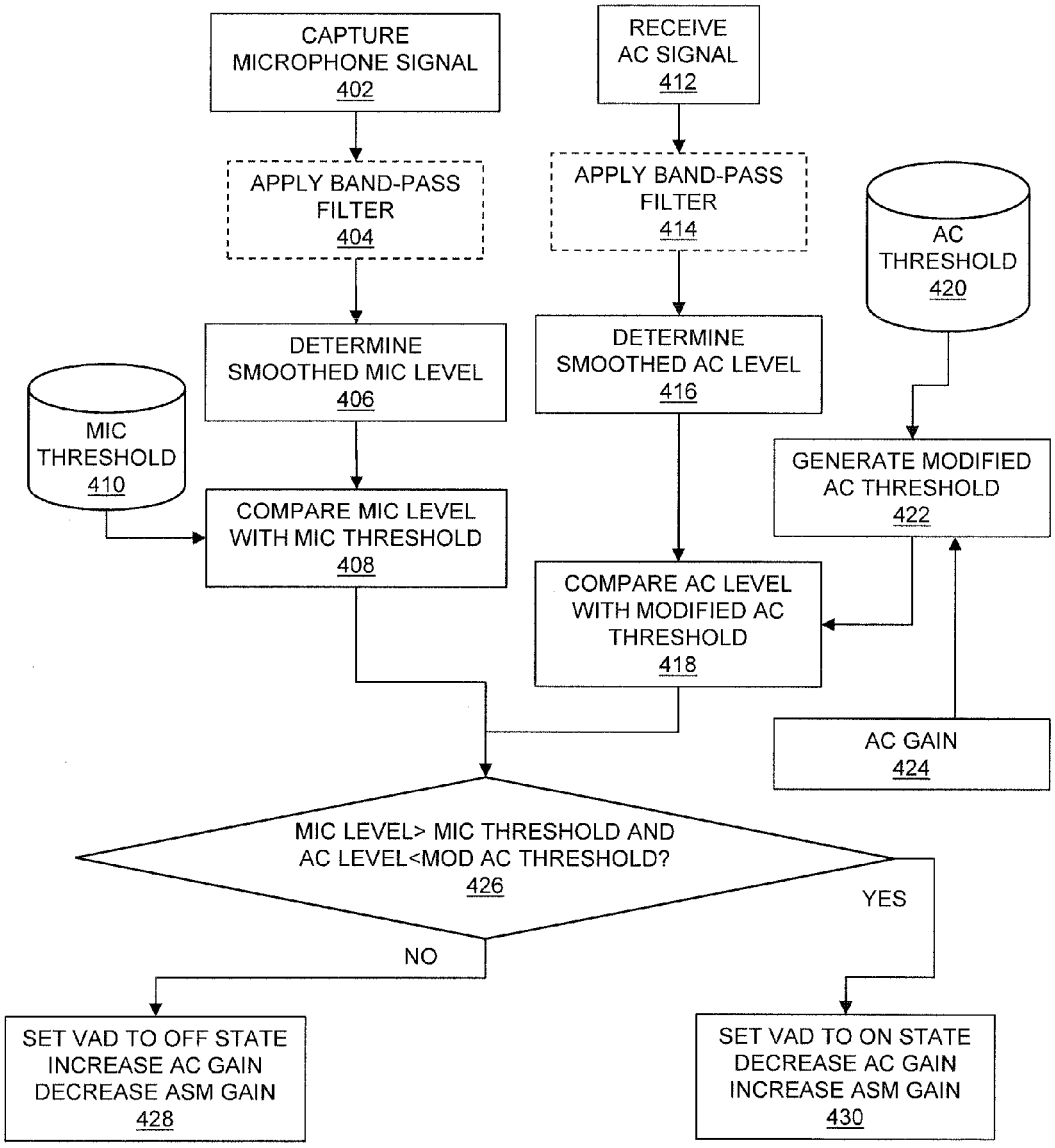
FIG. 4 is a flowchart of an exemplary method for determining user voice activity of a sound isolating earphone device, according to an embodiment of the present invention.

Referring next to FIG. 4, a flowchart of an exemplary method is shown for determining user voice activity by VAD system 302 (FIG. 3), according to an embodiment of the present invention.

According to an exemplary embodiment, voice activity of the user of earphone device 100 (FIG. 1) (i.e., the earphone wearer) may be detected by analysis of a microphone signal captured from a microphone. According to one example, the voice activity may be detected by analysis of an ECM signal from ECM 106 (FIG. 1), where ECM 106 detects sound in the occluded ear canal 124. According to another exemplary embodiment, voice activity may be detected by analysis of an ASM signal from ASM 120. In this case, the method described in FIG. 4 is the same except that the ECM signal (from ECM 106 of FIG. 1) is exchanged with the ASM signal from the ASM 120. At step 402, a microphone signal is captured. The microphone signal 402 may be captured by ECM 106 or by ASM 120.

At optional step 404 the microphone signal may be band-pass filtered, for example, by filter 312 (FIG. 3). In an exemplary embodiment, the band-pass filter 312 (FIG. 3) has a lower cut-off frequency of approximately 150 Hz and an upper cut-off frequency of approximately 200 Hz, using a 2nd or 4th order infinite impulse response (IIR) filter or 2 chain biquadratic filters (biquads).

At step 406, a time-smoothed level of the microphone signal (step 402) or the filtered microphone signal (step 404) is determined, to form a microphone signal level value ("mic level"). The microphone signal level may be determined, for example, by smoothed level generator 314 (FIG. 3). For example, the microphone signal may be smoothed using a 100 ms Hanning window.

At step 412, input audio content (AC) signal 320 (FIG. 3) (e.g., speech or music audio from a remote device) may be received. At optional step 414, the AC signal 320 may be band-pass filtered, for example by filter 312 (FIG. 3). In an exemplary embodiment, the band-pass filter is between about 150 and about 200 Hz, using a 2nd or 4th order IIR filter or 2 chain biquads.

At step 416, a time-smoothed level of AC signal (step 412) or the filtered AC signal (step 414) is determined (e.g., smoothed using a 100 ms Hanning window), such as by smoothed level generator 314 (FIG. 3), to generate an AC signal level value ("AC level").

At step 408, the microphone signal level value (determined at step 406) is compared with a microphone threshold 410 (also referred to herein as mic threshold 410), for example, by signal level comparator 316 (FIG. 3). Microphone threshold 410 may be stored, for example, in memory 104 (FIG. 1).

At step 418, the AC signal level value (determined at step 416) is compared with a modified AC threshold (determined at step 422), for example, by signal level comparator 316 (FIG. 3). The modified AC threshold is generated at step 422 by multiplying a linear AC threshold 420 with a current linear AC signal gain 424. AC threshold 420 may be stored, for example, in memory 104 (FIG. 1).

At step 426, it is determined whether voice activity is detected. At step 426, if it is determined (for example by comparator 316 of FIG. 3) that the microphone level is greater than the microphone threshold 410 (mic level>mic threshold) and the AC level is less than the modified AC threshold (AC level<modified AC threshold), then the state of VAD system 302 (FIG. 3) is set to an on state at step 430. Otherwise VAD system 302 (FIG. 3) is set to an off state at step 428.

At step 430, when voice activity is detected (i.e. VAD=on state), the level of ASM signal 322 (FIG. 3) provided to ECR 114 (FIG. 1) is increased by increasing Gain_ASM (via gain stage 306), and the level of AC signal 320 provided to ECR 114 is decreased by decreasing Gain_AC (via gain stage 304).

At step 428, when voice activity is not detected (i.e. VAD=off state), the level of ASM signal 322 (FIG. 3) provided to ECR 114 (FIG. 1) is decreased by decreasing Gain_ASM, and the level of AC signal 320 provided to ECR 114 is increased by increasing Gain_AC. A maximum value of gain_AC and gain_ASM may be limited, e.g. to about unity gain, and in one exemplary embodiment a minimum value of gain_AC and gain_ASM may be limited, e.g. to about 0.0001 gain.

In an exemplary embodiment, a rate of gain change (slew rate) of the gain_ASM and the gain_AC in mixer unit 308 (FIG. 3) may be independently controlled and may be different for "gain increasing" and "gain decreasing" conditions. In one example, the slew rate for increasing and decreasing "AC gain" in the mixer unit 308 is about 30 dB per second and about −30 dB per second, respectively. In an exemplary embodiment, the slew rate for increasing and decreasing "ASM gain" in mixer unit 308 may be inversely proportional to the gain_AC (on a linear scale, the gain_ASM is equal to the gain_AC subtracted from unity).

Figure 5:
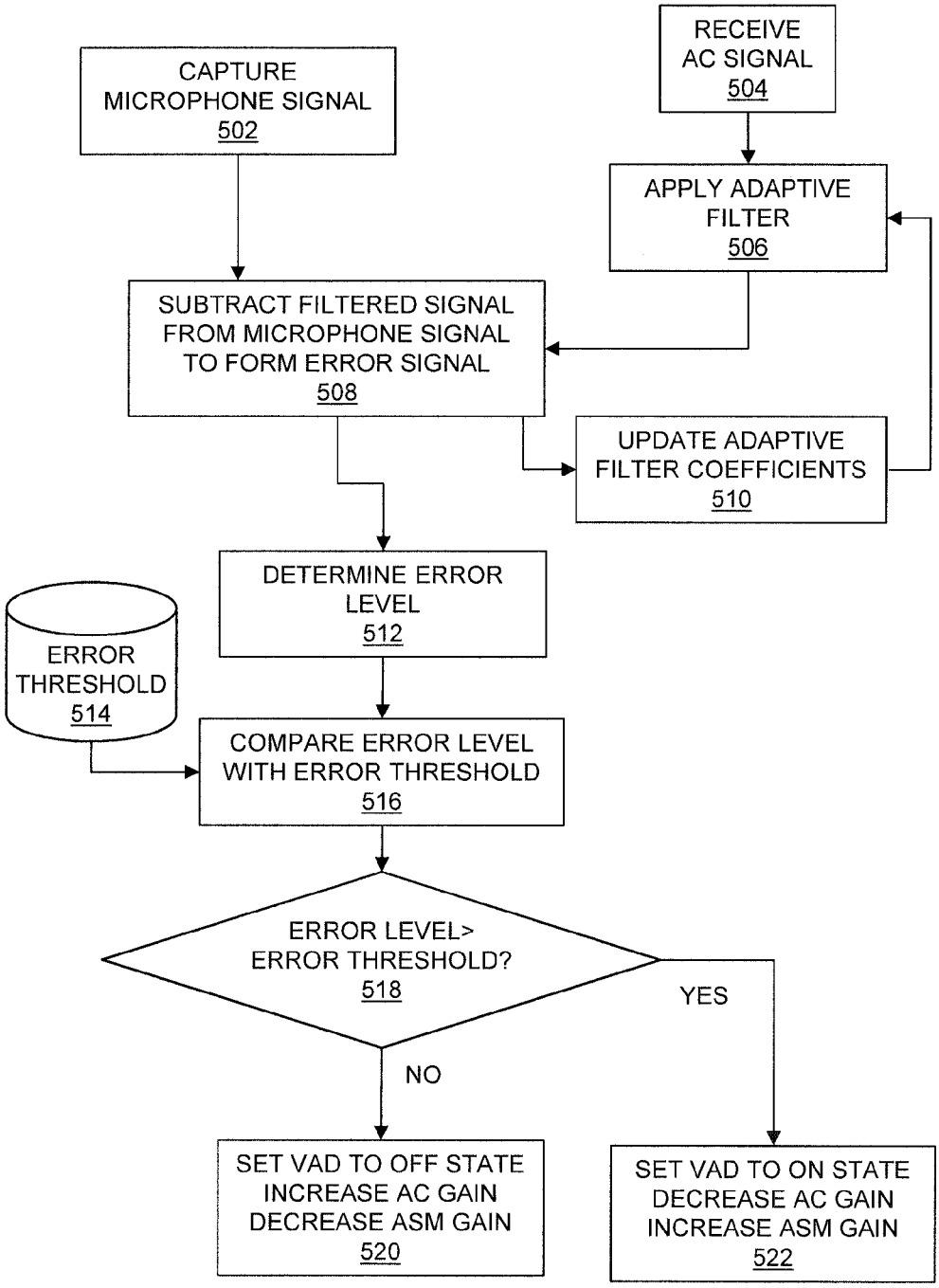
FIG. 5 is flowchart of an exemplary method for determining user voice activity of a sound isolating earphone device, according to another embodiment of the present invention.

Referring next to FIG. 5, a flowchart of an exemplary method is shown for determining user voice activity by VAD system 302 (FIG. 3), according to another embodiment of the present invention.

At step 502, a microphone signal is captured. The microphone signal may be captured by ECM 106 (FIG. 1) or by ASM 120. At step 504, AC signal 320 (FIG. 3) is received.

At step 506, the AC signal 320 is adaptively filtered by an adaptive filter, such as filter 312 (FIG. 3). At step 508, the filtered signal (step 506), is subtracted from the captured microphone signal (step 502), resulting in an error signal. At step 510, the error signal (step 508) may be used to update adaptive filter coefficients (for the adaptive filtering at step 506). For example, the adaptive filter may include a normalized least mean squares (NLMS) adaptive filter. Steps 506-510 may be performed, for example, by filter 312 (FIG. 3)

At step 512, an error signal level value ("error level") is determined, for example, by smoothed level generator 314 (FIG. 3). At step 516 the error level is compared with an error threshold 514, for example, by signal level comparator 316 of FIG. 3. The error threshold 514 may be stored in memory 104 (FIG. 1).

At step 518 it is determined (for example, by signal level comparator 316 of FIG. 3) whether the error level (step 512) is greater than the error threshold 514. If it is determined, at step 518, that the error level is greater than the error threshold 514, step 518 proceeds to step 522, and VAD system 302 (FIG. 3) is set to an on state. Step 522 is similar to step 430 in FIG. 4.

If it is determined, at step 518, that the error level is less than or equal to error threshold 514, step 518 proceeds to step 520, and VAD system 302 (FIG. 3) is set to an off state. Step 520 is similar to step 428 in FIG. 4.

Figure 6A:
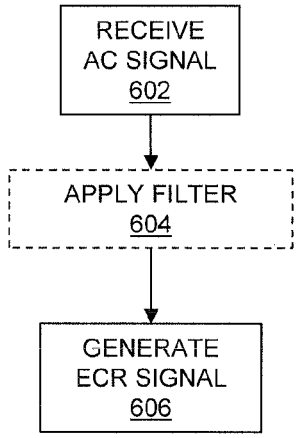
FIGS. 6A and 6B are flowcharts of an exemplary method for determining user voice activity of a sound isolating earphone device, according to another embodiment of the present invention.
Figure 6B:
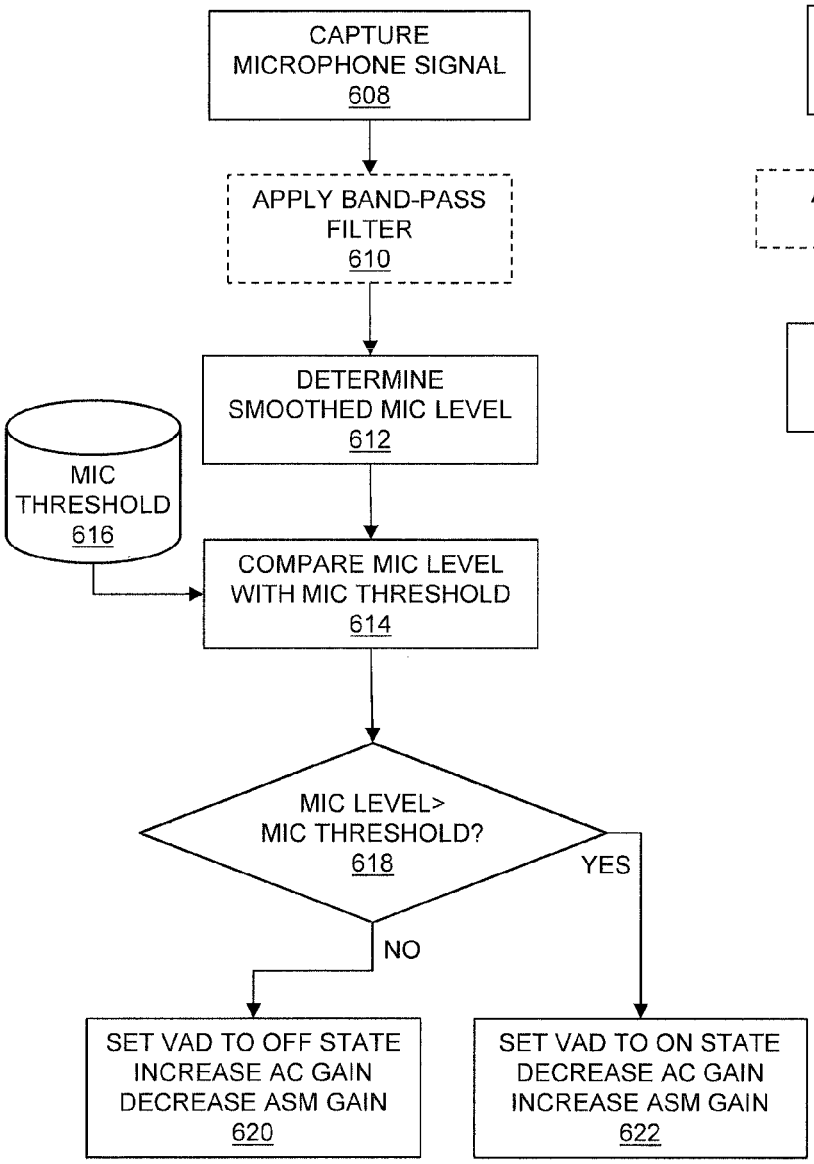

Referring next to FIGS. 6A and 6B, flowcharts are shown of an exemplary method for determining user voice activity by VAD system 302 (FIG. 3), according to another embodiment of the present invention. FIGS. 6A and 6B show modifications of the method of voice activity detection shown in FIG. 4.

Referring FIG. 6A, the exemplary method shown may be advantageous for band-limited input AC signals 320 (FIG. 3), such as speech audio from a telephone system that is typically band-limited to between about 300 Hz and about 3 kHz. At step 602, AC signal 320 is received. At optional step 614, AC signal 320 may be filtered (e.g., high-pass filtered or band-pass filtered, such as by filter 312 of FIG. 3), to attenuate or remove low frequency components, or a region of low-frequency components, in the input AC audio signal 612. At step 606, an ECR signal may be generated from the AC signal 320 (which may be optionally filtered at step 614) and may be directed to ECR 114 (FIG. 1).

Referring next to FIG. 6B, at step 608, a microphone signal is captured. The microphone signal may be captured by ECM 106 (FIG. 1) or by ASM 120. At optional step 610, the microphone signal may be band-pass filtered, similarly to step 404 (FIG. 4), for example, by filter 312 (FIG. 3). At step 612, a time-smoothed level of the microphone signal (captured at step 608) or the filtered microphone signal (step 610) may be determined, similarly to step 406 (FIG. 4), to generate a microphone signal level value ("mic level").

At step 614, the microphone signal level value is compared with a microphone threshold 616, similarly to step 408 (FIG. 4). At step 618 it is determined whether voice activity is detected.

At step 618, if it is determined (for example by signal level comparator 316 of FIG. 3) that the microphone Level is greater than the microphone threshold, then VAD system 302 (FIG. 3) is set to an on state at step 622. Otherwise VAD system 302 is set to an off state at step 620. Steps 620 and 622 are similar to respective steps 428 and 430 (FIG. 4).

Figure 7:
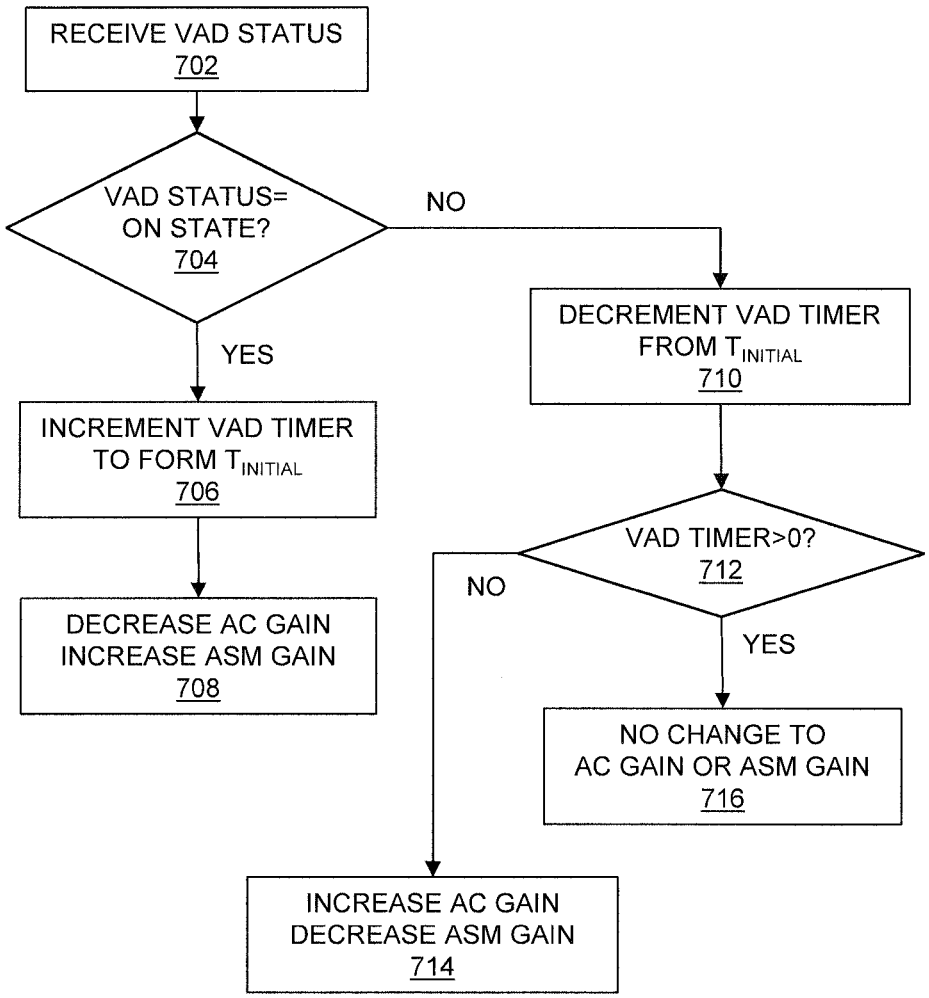
FIG. 7 is a flowchart of an exemplary method for controlling input audio content (AC) gain and ambient sound microphone (ASM) gain of an exemplary earphone system, according to an embodiment of the present invention.

Referring next to FIG. 7, a flowchart is shown of an exemplary method for controlling input AC gain and ASM gain by signal processing system 206 (FIG. 3) including VAD timer system 310, according to an embodiment of the present invention. In FIG. 7, following cessation of detected user voice activity by VAD system 302, and following a "pre-fade delay," the level of the ASM signal provided to ECR 114 (FIG. 1) is decreased and the level of the AC signal provided to ECR 114 is increased.

In an exemplary embodiment, the time period of the "pre-fade delay" (referred to herein as $T_{initial}$) may be proportional to a time period of continuous user voice activity (before cessation of the user voice activity), and the "pre-fade delay" time period $T_{initial}$ may be bound by a predetermined upper limit value ($T_{max}$), which in an exemplary embodiment is between about 5 and 20 seconds.

At step 702, the VAD status (i.e., an on state or an off state) is received (at VAD timer system 310). At step 704 it is determined whether voice activity is detected by VAD system 302, based on whether the VAD status is in an on state or an off state.

If voice activity is detected at step 704 (i.e., the VAD status is an on state), then a VAD timer (of VAD timer system 310 (FIG. 3) is incremented at step 706. In an example embodiment, the VAD timer may be limited to a predetermined time $T_{max}$ (for example, about 10 seconds).

At step 708, the gain_AC is decreased and the gain_ASM is increased (via gain stages 304 and 306 in FIG. 3).

If voice activity is not detected at step 704 (i.e., the VAD status is an off state), then the VAD timer is decremented at step 710, from an initial value, $T_{initial}$. The VAD timer may be limited at step 712 so that the VAD timer is not decremented to less than 0. As discussed above, $T_{initial}$ may be determined from a last incremented value (step 706) of the VAD timer (prior to cessation of voice activity). The initial value $T_{initial}$ may also be bound by the predetermined upper limit value $T_{max}$.

If it is determined, at step 712, that the VAD timer is equal to 0, step 712 proceeds to step 714. At step 714, the AC gain value is increased and the ASM gain is decreased (via gain stages 304, 306 of FIG. 3).

If it is determined, at step 712, that the VAD timer is greater than 0, step 712 proceeds to step 716. At step 716, the AC gain and ASM gain remain unchanged. Thus, the VAD timer system 310 (FIG. 3) may provide a delay period between cessation of voice activity detection and changing of the gain stages for corresponding to the VAD off state.

Although the invention has been described in terms of systems and methods for automatically passing ambient sound to an earphone device, it is contemplated that one or more steps and/or components may be implemented in software for use with microprocessors/general purpose computers (not shown). In this embodiment, one or more of the functions of the various components and/or steps described above may be implemented in software that controls a computer. The software may be embodied in non-transitory tangible computer readable media (such as, by way of non-limiting example, a magnetic disk, optical disk, flash memory, hard drive, etc.) for execution by the computer.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A method for passing ambient sound to an earphone device configured to be inserted in an ear canal of a user, the method comprising the steps of:

capturing the ambient sound from an ambient sound microphone (ASM) proximate to the earphone device to form an ASM signal;

receiving an audio content (AC) signal from a remote device;

detecting voice activity of the user of the earphone device;

mixing the ASM signal and the AC signal to form a mixed signal, such that, in the mixed signal, an ASM gain of the ASM signal is increased and an AC gain of the AC signal is decreased when the voice activity is detected;

detecting a cessation of the voice activity;

delaying modification of the ASM gain and the AC gain for a predetermined time period responsive to the detected cessation of the voice activity; and directing the mixed signal to an ear canal receiver (ECR) of the earphone device.

2. The method according to claim 1, wherein the mixing of the ASM signal and the AC signal includes decreasing the ASM gain of the ASM signal and increasing the AC gain of the AC signal when the voice activity is not detected.

3. The method according to claim 1, wherein the AC gain and the ASM gain are selected according to whether the voice activity is detected.

4. The method according to claim 3, wherein the mixing of the ASM signal and the AC signal includes:

applying the ASM gain to the ASM signal to generate a modified ASM signal;

applying the AC gain to the AC signal to generate a modified AC signal; and mixing the modified ASM signal and the modified AC signal to form the mixed signal.

5. The method according to claim 1, wherein each of the AC gain and the ASM gain is greater than zero and less than or equal to unity gain.

6. The method according to claim 1, wherein the AC signal is received from the remote device via a wired connection or a wireless connection.

7. A method for passing ambient sound to an earphone device configured to be inserted in an ear canal of a user, the method comprising the steps of:

capturing the ambient sound from an ambient sound microphone (ASM) proximate to the earphone device to form as ASM signal;

receiving an audio content (AC) signal from a remote device;

detecting voice activity of the user of the earphone device, wherein the detecting of the voice activity includes:

determining a time-smoothed level of a microphone signal to form a microphone level;

comparing the microphone level with a predetermined microphone level threshold; and detecting the voice activity when the microphone level is greater than the microphone level threshold; and mixing the ASM signal and the AC signal to form a mixed signal, such that, in the mixed signal, an ASM gain of the ASM signal is increased and an AC gain of the AC signal is decreased when the voice activity is detected.

8. The method according to claim 7, wherein the detecting of the voice activity includes detecting the voice activity from the microphone signal, the microphone signal including at least one of the ASM signal or an ear canal microphone (ECM) signal captured within the ear canal from an ECM of the earphone device.

9. The method according to claim 8, the method including filtering at least one of the microphone signal or the AC signal by a predetermined filtering characteristic.

10. The method according to claim 7, wherein the detecting of the voice activity includes:

determining a time-smoothed level of the AC signal to form an AC level;

comparing the AC level with an AC level threshold; and detecting the voice activity when the microphone level is greater than the microphone level threshold and the AC level is less than the AC threshold.

11. The method according to claim 10, wherein the AC threshold value is modified by a predetermined AC gain coefficient value.

12. The method according to claim 8, wherein the detecting of the voice activity includes:

adaptively filtering the AC signal to form a filtered AC signal;

determining a difference between the microphone signal and the filtered AC signal to form an error signal;

determining a time-smoothed level of the error signal to form an error level;

comparing the error level with an error threshold; and detecting the voice activity when the error level is greater than the error level threshold.

13. An earphone system comprising:

at least one earphone device including:

a sealing section configured to conform to an ear canal of a user of the earphone device;

an ear canal receiver (ECR);

an ambient sound microphone (ASM) for capturing ambient sound proximate to the earphone device and to form an ASM signal;

a signal processing system configured to:

receive an audio content (AC) signal from a remote device, detect voice activity of the user of the earphone device, mix the ASM signal and the AC signal to form a mixed signal, such that, in the mixed signal, an ASM gain of the ASM signal is increased and an AC gain of the AC signal is decreased when the voice activity is detected, and direct the mixed signal to the ECR; and a voice activity detector (VAD) timer system configured to:

detect a cessation of the voice activity, and delay modification of the ASM gain and the AC gain for a predetermined time period responsive to the detected cessation of the voice activity.

14. The earphone system according to claim 13, wherein the at least one earphone device includes at least two earphone devices.

15. The earphone system according to claim 13, wherein the remote device includes at least one of a mobile phone, a radio device, a computing device, a portable media player, an earphone device of a different user or a further earphone device of the user.

16. The earphone system according to claim 13, further comprising a communication system configured to receive the AC signal from the remote device via a wired or wireless connection.

17. The earphone system according to claim 13, wherein the signal processing system is further configured to decrease the ASM gain of the ASM signal and increase the AC gain of the AC signal prior to mixing the ASM signal and the ASM signal when the voice activity is not detected.

18. The earphone system according to claim 13, further comprising:

a voice activity detector (VAD) system configured to detect the voice activity from a microphone signal, the microphone signal including at least one of the ASM signal or an ear canal microphone (ECM) signal captured within the ear canal from an ECM of the earphone device.

19. The earphone system according to claim 18, wherein the VAD system is configured to:

determine a time-smoothed level of the AC signal to form an AC level, compare the AC level with an AC level threshold, and detect the voice activity when the microphone level is greater than the microphone level threshold and the AC level is less than the AC threshold.

20. The earphone system according to claim 19, wherein the VAD system is configured to:

determine a time-smoothed level of the AC signal to form an AC level, compare the AC level with an AC level threshold, and detect the voice activity when the microphone level is greater than the microphone level threshold and the AC level is less than the AC threshold.

21. The earphone system according to claim 18, wherein the VAD system is configured to:

adaptively filter the AC signal to form a filtered AC signal, determine a difference between the microphone signal and the filtered AC signal to form an error signal, determine a time-smoothed level of the error signal to form an error level, compare the error level with an error threshold, and detect the voice activity when the error level is greater than the error level threshold.

* * * * *